United States Patent [19]

Oldham

[11] 4,180,883

[45] Jan. 1, 1980

[54] BUOYANCY AID

[75] Inventor: Walter Oldham, Rochdale, England

[73] Assignee: Beaufort (Air-Sea) Equipment Limited, Cheshire, England

[21] Appl. No.: 860,197

[22] Filed: Dec. 13, 1977

[51] Int. Cl.[2] ..... B63C 9/08

[52] U.S. Cl. ..... 9/312; 9/337

[58] Field of Search ..... 9/311, 312, 313, 336, 9/337, 338

[56] References Cited

U.S. PATENT DOCUMENTS

| | | | |
|---|---|---|---|
| 691,341 | 1/1902 | Gore | 9/336 |
| 999,856 | 8/1911 | Paschke | 9/337 |
| 1,478,351 | 12/1923 | O'Shaughnessy | 9/336 |
| 2,094,499 | 9/1937 | Scavo | 9/337 |
| 2,310,840 | 2/1943 | Crabtree | 9/337 |
| 3,152,343 | 10/1964 | Brown | 9/312 |

FOREIGN PATENT DOCUMENTS

| | | | |
|---|---|---|---|
| 915784 | 6/1954 | Fed. Rep. of Germany | 9/337 |

*Primary Examiner*—Stephen G. Kunin
*Assistant Examiner*—D. W. Keen
*Attorney, Agent, or Firm*—Oblon, Fisher, Spivak, McClelland & Maier

[57] ABSTRACT

A cushion for an aircraft seat is made up of three buoyancy elements which after removal from the corresponding seat structure may be adjustably separated from one another, donned by a wearer, and, by attached straps, fastened to the wearer to provide the wearer with a buoyancy aid in the event of the aircraft ditching in the sea.

13 Claims, 2 Drawing Figures

BUOYANCY AID

BACKGROUND OF THE INVENTION

1. Field of the Invention

The present invention relates to a buoyancy aid.

2. Description of the Prior Art

In some countries it is the practice, in the event of a passenger aircraft making an emergency landing over water, for the passenger to rely upon the aircraft seat cushion for bouyancy. This reliance is not satisfactory since cushions of this form are difficult to hold onto in the best of conditions for any length of time and nearly impossible in the exposed conditions likely to exist in the event of an emergency.

SUMMARY OF THE INVENTION

According to the present invention, there is provided a cushion comprising three separate members made of a material buoyant in sea water joined to each other in such a way as to allow them to be donned by a person with one of the members disposed behind the neck and the others disposed on the chest.

A preferred embodiment of the invention may incorporate any one or more of the following advantageous features.

(a) The three members are each of parallelepipedic form.

(b) Each member is made of a foamed closed cell synthetic plastics material.

(c) The members are joined by flexible tapes.

(d) The tapes are made of synthetic plastics material.

(e) The tapes are joined to their respective members by adhesive.

(f) Each member is disposed in a textile jacket to which the tapes are joined by stitching.

(g) The members adapted to lie on the chest are provided with loops through which a tape may be passed to adjustably connect these members together.

(h) The members are all of the same depth and the length of the member adapted to lie behind the neck is twice the width of each of the other two members whereby, so that when the neck member is placed across the top of the other two members lying side by side, the resultant cushion is of substantially rectangular plan form.

(i) The cushion is housed in a seat cover.

(j) The top part of the cover is joined to the remainder by means of touch fasteners (velcro) to enable it to be drawn back to reveal the cushion underneath.

(k) The edge of the top part of the cover is provided with a handle to facilitate its drawing back.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBDOIMENT

Figure 2:
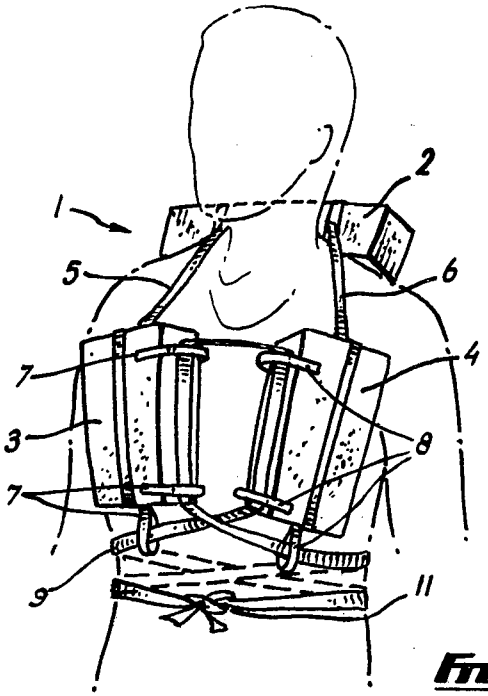
FIG. 2 shows the cushion from the seat of FIG. 1 removed therefrom on a wearer in accordance with the present invention.

Referring to the drawings, the buoyancy aid 1 comprises three members 2, 3 and 4 of an expanded closed cell synthetic plastics material such as polyvinyl chloride (p.v.c.), polythene, or ethylene vinyl acetate (e.v.a.). The member 2 is joined to the members 3 and 4 by respective tapes 5 and 6 of synthetic plastics material connected to the surfaces of the respective members by adhesive. Each of the members 3 and 4 comprises three loops (7, 8) also fixed by the surface of the member by adhesive. For each of the members 3 and 4, two of the loops are disposed along the length and one at one end. An elongate tape 9 is threaded through the loops.

Figure 1:
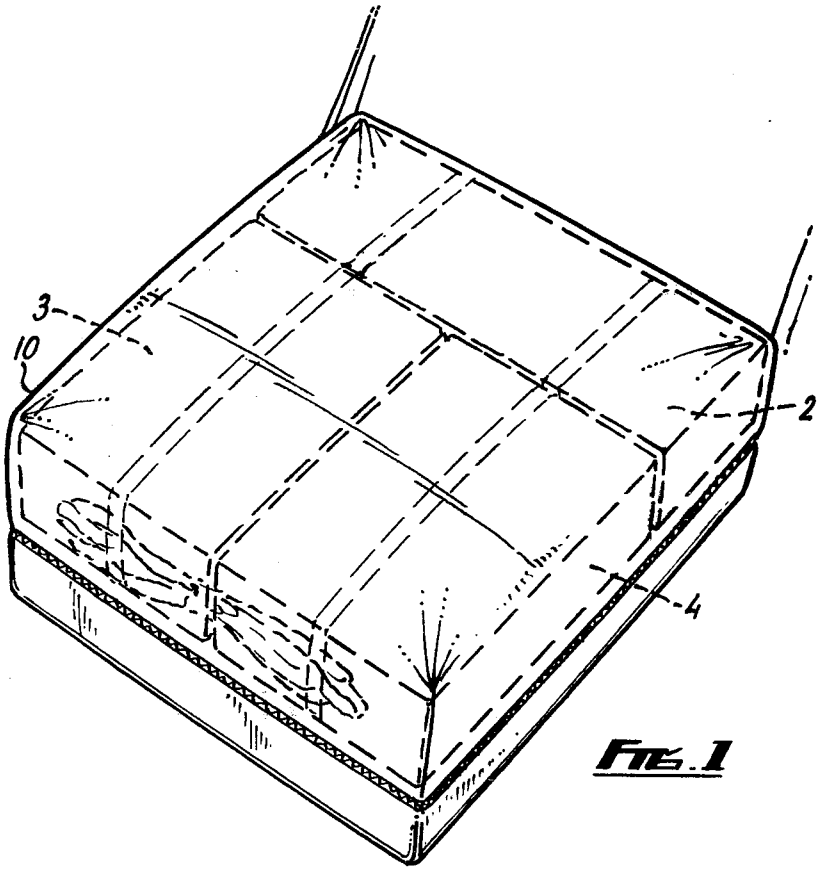
FIG. 1 shows a perspective view of a seat portion of an aircraft seat.

In an inoperative position in a seat (see FIG. 1), the members 3 and 4 are laid side by side and the member 2, which is equal in length to the combined widths of members 3 and 4, is placed along the top. The connecting tapes 5 and 6, the tape 9 and the loops 7 and 8 are carefully folded. The members are held together by the surrounding textile material of the seat cover 10 and when so held combine to provide the effect of a single cushion. To allow ready access to the buoyancy aid 1, the top layer of the seat cover is connected to the remainder of the cover by means of velcro or other similar fasteners. The top layer of the seat can then be easily pulled back and a handle portion (not shown) is stitched to the top cover to enable it to be readily grasped.

After the aid has been removed from the seat cover, it can be donned by the wearer. The wearer does this by pulling the members 3 and 4 away to the full extent from the member 2 provided by the tapes 5 and 6 and from each other provided by the elongate tape 9 slipping through the loops 7 and 8. the substantial length of the tape 9 provides for the displacement of the members 7 and 8 from each other to a correspondingly substantial extent and for a correspondingly large aperture through which the head of the wearer may be passed between the three members.

After pushing the head through the aperture and positioning the member 2 behind the neck and the members 3 and 4 on the chest, the free ends of the tape 9 are pulled to decrease the spacing between the members 3 and 4 from the spacing shown in FIG. 2 so that they are as close together as possible and then taken in opposite directions round the trunk and brought back for a front fastening at 11.

The above example has been described by way of example only and many variations are possible without departing from the scope of the invention. Where synthetic plastics material has been specified for tapes natural fibres may equally well be used. The members may be housed in textile jackets to which the tapes and loop associated with them are stitched. If the jackets are made waterproof the nature of the material of the member may be changed. For example open cell material may be used. Instead of housing the aid in the seat part of the seat, it may equally well be housed in the squab portion. where the aid is in the seat, the bottom part of the seat cover may be detachably attached by means of velcro or like means such as snap fasteners (not shown). Also, although the above embodiment shows a regularly shaped seat, the invention could of course be adapted to cater for irregularly shaped seats and in particular for any shape of aircraft seat in general use at the present time.

What is claimed as new and desired to be secured by letters patent of the United States of America is:

1. A cushion convertible into a life preserver which comprises:

a first, second, and third separate member made of bouyant material, said first, second, and third members being disposed adjacent each other in substantially the same plane so as to form said cushion for seating wherein, upon being worn as said life preserver, said first member is disposed adjacent to and behind the head of the wearer and said second and third members are disposed adjacent each other on the chest of the wearer;

a plurality of loop members secured to each of said first, second and third members;

a first tape disposed within said plurality of loop members of said second and third members so as to interconnect said second and third members wherein ends of said first tape are drawn in opposite directions around the body of the wearer and are secured together upon being worn as a life preserver; and a second tape disposed within said plurality of loop members of said first member and interconnecting said second and third members wherein each of said first, second and third members upon forming said cushion are of the same depth and the length of said first member is twice the width of each of said second and third members, said second and third members being disposed adjacent each other and wherein said first member is disposed adjacent an end portion of said second or third members such that the cushion is of a substantially rectangular plan form.

2. A cushion as claimed in claim 1, in which said second tape is joined to said second and third members by adhesive.

3. A cushion as claimed in claim 1, in which said first and second tapes are made of synthetic plastics material.

4. A cushion as set forth in claim 1 wherein said first, second, and third members are each of parallelepipedic form.

5. A cushion as claimed in claim 1, in which said first, second, and third members are each of parallelepipedic form.

6. A cushion as claimed in claim 1, which further comprises a textile jacket within which said first, second and third members are disposed so as to form said cushion.

7. A cushion as claimed in claim 1, in which each of said first, second, and third members is made of a foamed, closed cell, synthetic plastics material.

8. A cushion as set forth in claim 7, wherein said synthetic plastics material comprises polyvinyl chloride.

9. A cushion as set forth in claim 7, wherein said synthetic plastics material comprises polythene.

10. A cushion as set forth in claim 7, wherein said synthetic plastics material comprises ethylene vinyl acetate.

11. A cushion as claimed in claim 1, which further comprises a seat cover within which said cushion is disposed.

12. A cushion as claimed in claim 10, wherein said cushion includes a top portion and a remaining end portion, wherein said cushion further comprises means for fastening said top portion of said seat cover to said remaining end portion of said seat cover so as to enable removal of said top portion and provide access to said cushion.

13. A cushion convertible into a life preserver which comprises:

a first, second, and third separate member made of buoyant material, said first, second, and third members being disposed adjacent each other in substantially the same plane so as to form said cushion for seating;

a plurality of loop members secured to said first member and to surface portions of said second and third members and at least one loop member secured to an end portion of said first and second members;

a first tape disposed within said plurality of loop members of said second and third members so as to interconnect said second and third members and further disposed within each of said at least one end portion loop member of said first and second members; and a second tape disposed within said plurality of loop members of said first member and interconnecting said second and third members in which each of said first, second, and third members are of the same depth, the length of said first member being twice the width of each of said second and third members wherein said second and third members are disposed adjacent each other and wherein said first member is disposed adjacent an end portion of said second and third members such that said cushion is of a substantially rectangular plan form.

* * * * *